US005449192A

United States Patent [19]

Challande et al.

[11] Patent Number: 5,449,192

[45] Date of Patent: Sep. 12, 1995

[54] BOOT SUPPORT PLATE FOR SKI BINDING

[75] Inventors: Christian Challande, Cruseilles; Pascal Baron, Seynod; Pascal Thomas, Chamberry, all of France

[73] Assignee: Salomon S. A., Annecy, France

[21] Appl. No.: 181,977

[22] Filed: Jan. 18, 1994

Related U.S. Application Data

[63] Continuation-in-part of Ser. No. 856,051, filed as PCT/FR91/00705, Sep. 4, 1991, abandoned.

[30] Foreign Application Priority Data

Sep. 12, 1990 [FR] France ..... 9011513
Jul. 17, 1991 [FR] France ..... 9109309

[51] Int. Cl.[6] ..... A63C 9/00
[52] U.S. Cl. ..... 280/636
[58] Field of Search ..... 280/636, 634, 633, 623, 280/610, 625

[56] References Cited

U.S. PATENT DOCUMENTS

| | | | |
|---|---|---|---|
| 4,516,792 | 5/1985 | Scheck et al. | 280/636 X |
| 4,561,673 | 12/1985 | Pascal et al. | 280/636 X |
| 4,657,279 | 4/1987 | Pascal et al. | 280/636 |
| 4,735,435 | 4/1988 | Hornschemeyer et al. | 280/634 X |
| 4,784,404 | 11/1988 | Kowatsch | 280/636 X |
| 4,889,359 | 12/1989 | Kowatsch et al. | 280/636 X |
| 4,911,463 | 3/1990 | Gertsch | 280/636 X |
| 5,188,388 | 2/1993 | Rohrmoser | 280/633 |
| 5,215,326 | 6/1993 | Baron et al. | 280/636 |
| 5,222,756 | 6/1993 | Gorza | 280/634 X |
| 5,303,950 | 4/1994 | Rigal et al. | 280/636 |
| 5,338,051 | 8/1994 | Szafranski et al. | 280/610 X |

FOREIGN PATENT DOCUMENTS

| | | | |
|---|---|---|---|
| 0035951 | 2/1981 | European Pat. Off. . | |
| 0345371 | 12/1989 | European Pat. Off. | 280/636 |
| 2082219 | 12/1971 | France . | |
| 2150314 | 7/1972 | France . | |
| 2265423 | 3/1975 | France . | |
| 2615748 | 5/1987 | France . | |
| 2615747 | 12/1988 | France | 280/636 |
| 2121742 | 3/1972 | Germany | 280/636 |
| 2500686 | 8/1975 | Germany . | |
| 2905837 | 8/1980 | Germany | 280/634 |

*Primary Examiner*—Mitchell J. Hall
*Assistant Examiner*—F. Zeender
*Attorney, Agent, or Firm*—Pollock, Vande Sande & Priddy

[57] ABSTRACT

A support plate connected to a front ski binding and designed to support the front part of a boot. The support plate comprises a base plate (6) solidly joined to the base of the binding and a support (7) forming a component separate from the base plate (6). An anti-friction plate (5) is mounted in final position on the support (7) and the support is movably assembled to the base plate (6) by interlocking and reversible locking elements.

10 Claims, 4 Drawing Sheets

BOOT SUPPORT PLATE FOR SKI BINDING

This application is a continuation-in-part of application Ser. No. 07/856,051, filed as PCT/FR91/00705, Sep. 4, 1991, now abandoned.

FIELD OF THE INVENTION

The invention relates to boot-support plate intended to be connected to a front ski binding.

BACKGROUND OF THE INVENTION

Generally speaking, a boot is held in place on a ski by means of a front and a rear binding. In addition, the front end of the boot rests on a support plate connected to the front binding. The rear portion of the boot also rests on a support plate associated with the rear binding.

Conventionally-known support plates comprise a base with an upper part which incorporates a layer of material possessing a low coefficient of friction, on which the sole of the boot rests. This layer is constituted, for example, by the upper surface of a plate made of polytetrafluoroethylene.

This type of support plate is described, for example, in French Patents Nos. 2 533 832 and 2 615 748. The first of these documents describes the assembly of an anti-friction plate glued to a base, while the second describes a mechanical means of assembly, for example a catch mechanism.

The anti-friction plate is subjected to high stress levels by the boot, in particular when the boot is engaged in the binding or when it is released laterally.

Furthermore, it is known that the anti-friction plate/-base assembly deteriorates over time, and some anti-friction plates become partially or completely detached from their bases.

It thus becomes important to be able to detach a support plate so as to replace it with a new one.

Especially in the case of rental bindings, it is essential that the support plates be in good condition. As soon as a support plate deteriorates, it must be replaced. It is therefore desirable for the retailer to be in a position to effect this replacement very quickly, i.e., without the need for complex tools such as an electric sewing apparatus.

During such replacement, it is important for the anti-friction plate to be already gluded to the support. Such assemblage by gluing is a delicate operation. Given the important function of the plate in the operation of the binding, the assembly must be as perfect as possible, and hence should be performed at the factory, not by the retailer.

It is also desirable to minimize the cost of the replacement, i.e., by replacing only the deteriorated upper portion, rather than the entire support plate.

European Patent No. 404 848 describes a detachable support plate. However, the disadvantage of this device is that the support plate is assembled to the binding by means of the two rear screws which attach the binding to the ski. Accordingly, the replacement of the support plate requires that these screws be partially unscrewed and then retightened. This operation damages the engagement of the screws in the ski and, as a result, the mounting of the binding on the ski. Moreover, in this device, the entire base is replaced and, even though the anti-friction plate may be damaged, the base itself most often is not.

Another potential problem lies in the choice of the material for the base. In fact, this base must both bear the mechanical stresses generated by the boot and be compatible with the method of assembly of the anti-friction plate. Accordingly, to glue the anti-friction plate, the material used for the base must be compatible with the assembly technique. This material is not always appropriate for the mechanical stresses generated by the boot and to which the support plate is subjected. In this regard, it should be noted that the solution for mechanical assembly of the anti-friction plate, as described in French Patent No. 2 615 748, is not taken into consideration by the present invention, which envisages only assemblies formed by bonding or chemical-type assemblies. In other words, the assembly of the anti-friction plate to its support is final according to the invention, i.e., once mounted, the anti-friction plate cannot be detached from its support plate without damaging it or its support plate.

SUMMARY OF THE INVENTION

One of the objects of the invention is to propose a support plate in which the part carrying the anti-friction plate can be easily replaced.

Another object of the invention is to propose a support plate whose replacement does not require detachment of the entire base.

Another purpose of the invention is to propose a support plate whose base can withstand stresses of a completely different nature, in particular with respect to the method of assembly of the anti-friction plate, and to mechanical stresses generated by the boot on the support plate. Other purposes and advantages of the present invention will emerge during the following description.

The support plate connected to a front ski binding is designed to support the front part of a boot having a base extending behind the mounting plate of the binding and, attached to the latter, an anti-friction plate on which the sole of the boot rests, the anti-friction plate being interchangeable. This support plate is characterized by the fact that the base incorporates a base plate and a support element for the anti-friction plate which is independent of the base plate, that the anti-friction plate is mounted in final position on the support element, and that the support element is detachably assembled to the base plate using mutually interlocking means and reversible locking means.

BRIEF DESCRIPTION OF THE DRAWINGS

The invention will be better understood by reference to the description below and to the attached drawings.

DESCRIPTION OF PREFERRED EMBODIMENTS

Figure 1:
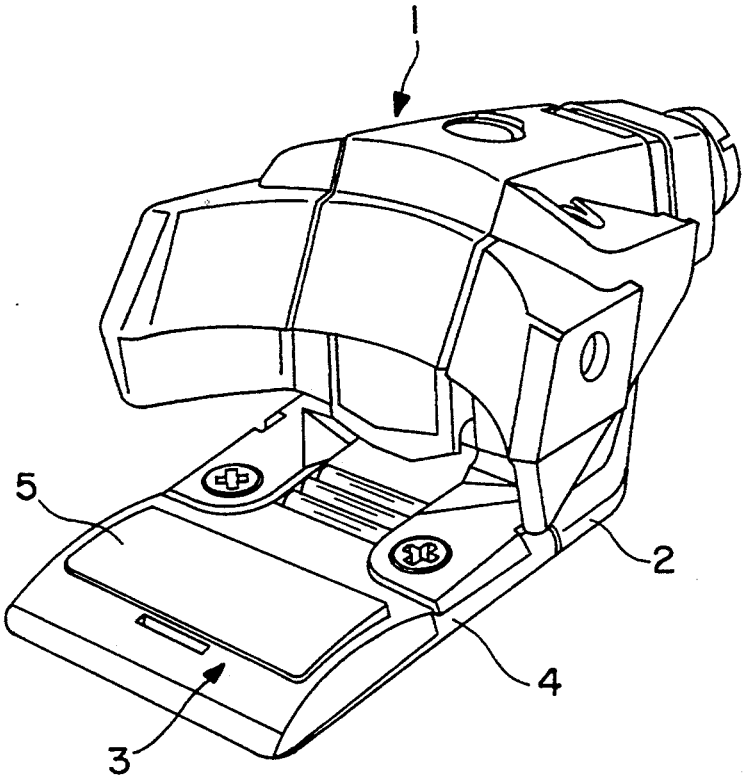
FIG. 1 is a perspective view of a front binding equipped with a support plate according to a first embodiment of the invention.

FIG. 1 illustrates a front binding 1, whose base 2 is designed to be attached to a ski using any appropriate means, such as screws.

The mounting element 2 is extended rearward by a support plate 3 whose principal components are a base 4 and a plate 5 made of an anti-friction material, such as a plate made of fluorinated resin or polytetrafluoroethylene. The plate 5 adheres to the base by any suitable means other than mechanical assembly such as adhesion by bonding with a cyanoacrylate or isocyanate acrylic glue, or by welding.

More generally, the plate 5 is mounted in final position on its support; i.e., it cannot be detached without being damaged or damaging its support element.

Figure 2:
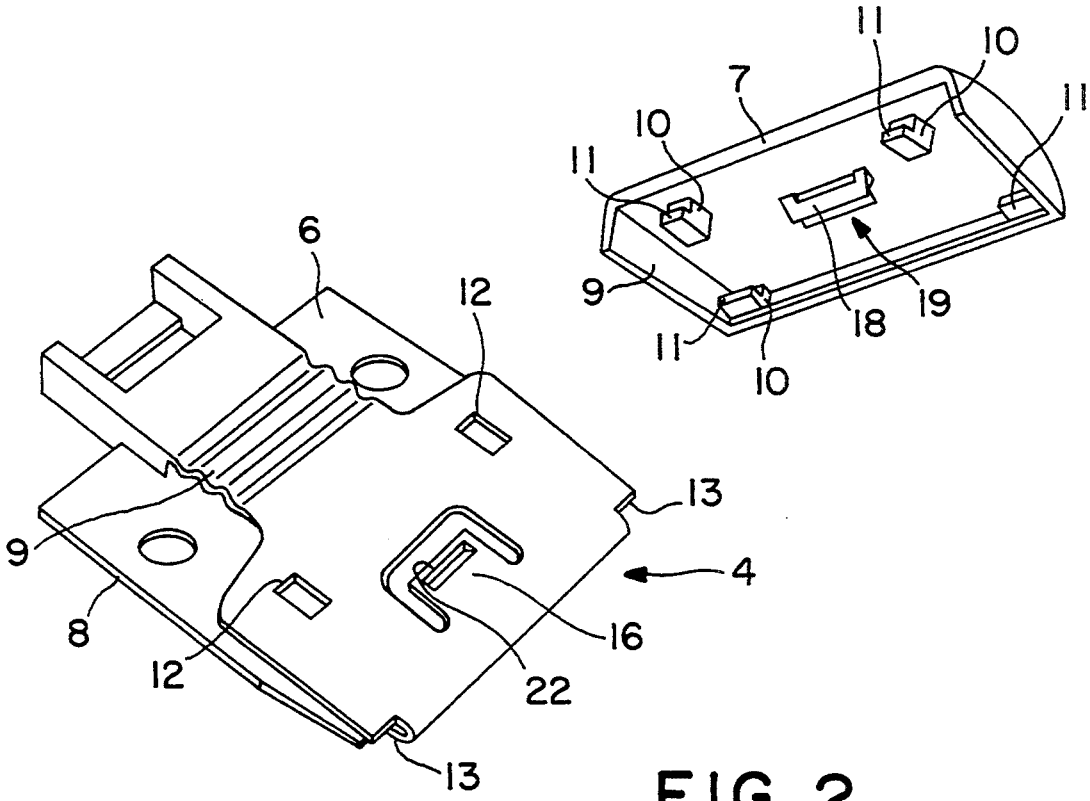
FIG. 2 is an exploded view of the principal components of the support plate shown in FIG. 1.
Figure 3:
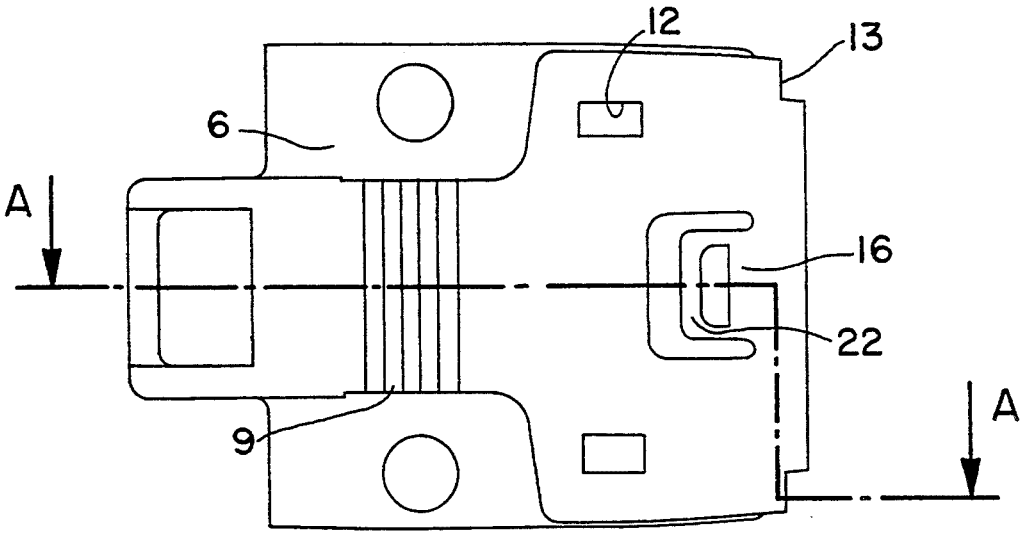
FIG. 3 is a top plan view of the base plate illustrated in FIG. 2.
Figure 4:
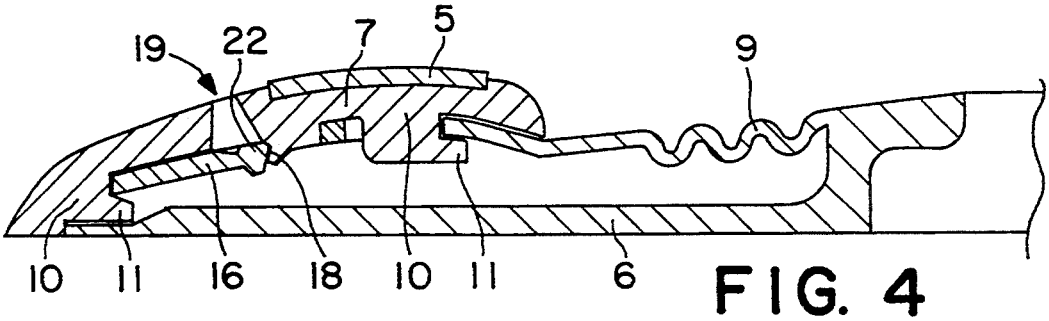
FIG. 4 is a cross-section view along line A—A in FIG. 3.
Figure 5:
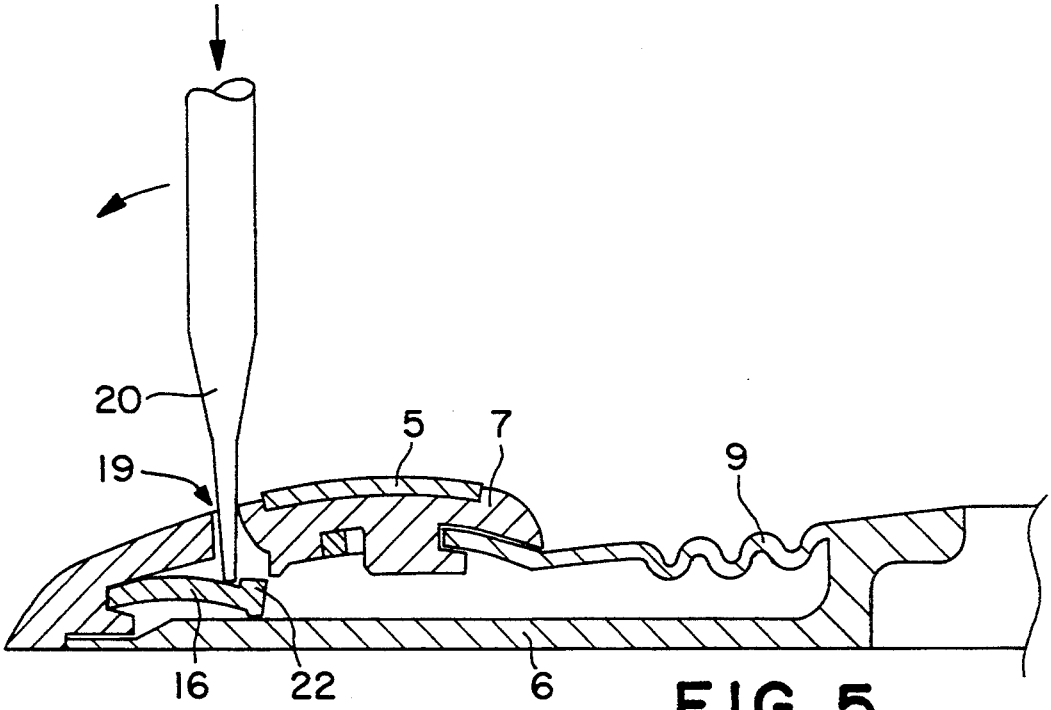
FIG. 5 illustrates the detachment of the support element.
Figure 6:
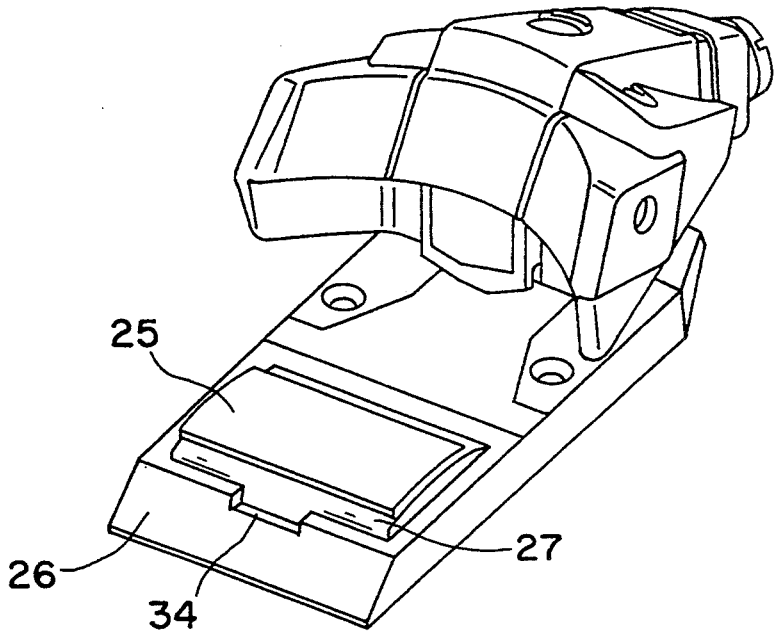
FIG. 6 is a perspective view of a front binding equipped with a support plate and illustrates a second embodiment of the invention.
Figure 7:
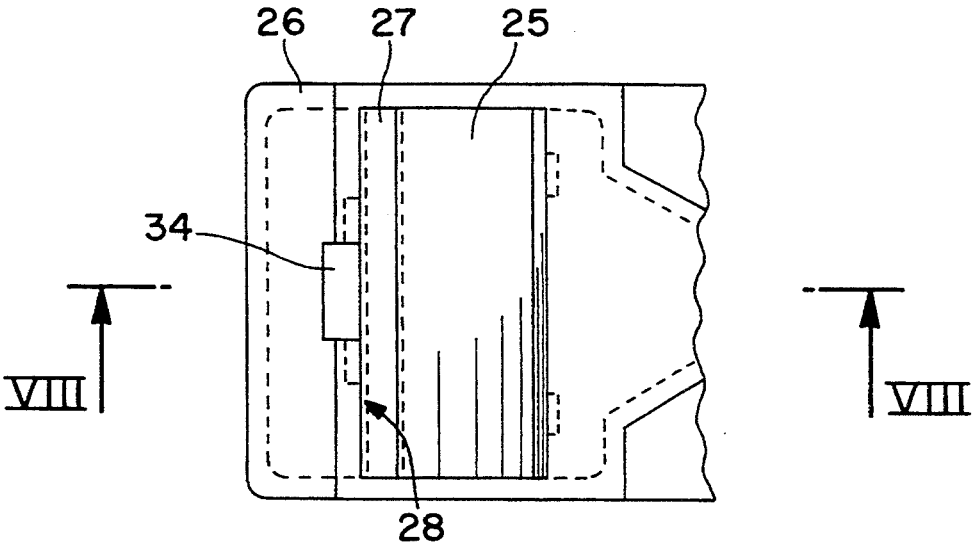
FIG. 7 is a top plan view of the support plate shown in FIG. 6.
Figure 8:
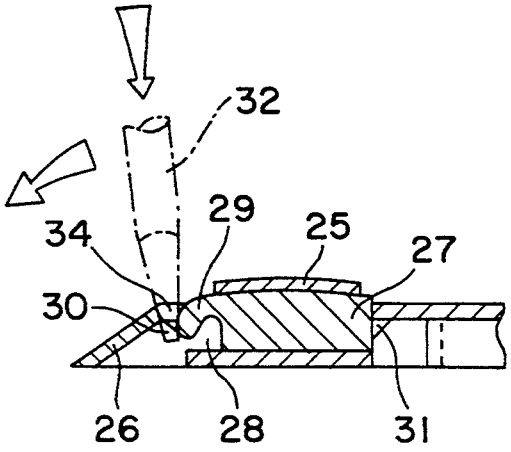
FIG. 8 is a cross-section view, in a vertical, longitudinal plane, of the support plate in FIG. 7.

As illustrated in FIG. 2, the support plate 3 comprises a base plate 6, which is solidly attached to the mounting element 2 of the binding, and a movable support 7. In the example shown, the base plate 6 is constituted by a sheet 8 of material which is folded over on itself and is sealed by means of an elastic bellows 9. This base plate is known, e.g., from U.S. Pat. No. 5,215,326 (see especially FIGS. 8 to 11 of this patent, which show an elastic bellows which enable automatic adjustment of the height of the support plate, similarly to bellows 9 of the instant invention) and it exhibits high vertical amplitude of compression because of the bellows 9 and the elasticity of the material forming sheet 8 which must, therefore, necessarily have a capacity for elastic deformation. This material may be a metal or, for example, a plastic material known under the trade name "DELRIN," which is famous for its elasticity and memory, i.e., its capacity to return to its original shape after deformation. On the other hand, a material of this kind is not compatible with mounting the anti-friction plate by adhesive bonding, using a cyanoacrylate-type glue. The material known as "Rilsan" may also be used.

The support 7 which carries the anti-friction plate 5 has, as seen in plan view, dimensions which allow it to cover the upper part of the base plate 6, at least in its rear area. It preferably also has two lateral sides 9 which extend over the edges of the base plate 6.

Since the support 7 is designed to carry the anti-friction plate 5, it is made of a material compatible with the method used to mount the plate. For example, the support 7 may be made of a plastic material known by the name "ABS," and the anti-friction plate is glued to this support using a cyanoacrylate or isocyanate-acrylic glue. This ABS material is compatible with adhesive bonding of the anti-friction plate, but the same material would not be suitable for manufacture of the base plate 7, since it does not possess the elasticity and memory properties required in the area of the base plate 6.

The support 7 is mounted movably on the support plate 6 using complementary mutual interlocking means and reversible locking means. The interlocking means function in an entirely longitudinal direction.

For the support 7, the interlocking means comprise four catch projections 10 positioned beneath the support, at approximately each of its corners. The catch projections 10 are extended downward and forward by horizontally extending tongues 11.

At the level of the base plate 6, the interlocking means comprise two front recesses 12 and two rear recesses 13, which are located at positions corresponding to the positions of the catch projections 10 of the support 7. The thickness of the base plate 6 in the area of the recesses 12 and 13 is approximately equal to the height of the catch projections 10.

The support is fitted on the base plate 6 by positioning the support in such a way that the catch projections 10 and their tongues 11 engage in the recesses 12 and 13. Once this engagement is produced, the components are interlocked by a simple forward motion of the support 7. The catch projections then form a stop preventing any forward or lateral motion of the support 7. The tongues form a stop preventing upward vertical motion.

The support 7 is assembled to the base plate 6 by locking means. In the base plate 6, these means comprise an elastic, forwardly extending tongue 16 designed to cooperate with a stop 18 positioned beneath the support 7. When the support 7 is put in place, this stop 18 is positioned just in front of the tongue 16, so that, by resting on the stop 18, the tongue prevents rearward movement of the support 7.

Just to the rear of this stop 18 and thus at the level of the tongue 16, the support 7 incorporates an opening 19, through which the blade 20 of a tool such as a screwdriver can be inserted. By means of this opening, the blade 20 can thus reach the elastic tongue 16 and exert downward pressure on this tongue so as to bend it, in such a way the stop 18 is no longer held by the tongue. The front part of tongue 16 advantageously has an edge 22. Thus, the insertion of the tool in the opening 19 causes the bending of the elastic tongue 16, and if the tool is then pivoted rearward while being supported on edge 22 of the elastic tongue 16, the blade 20 of the tool causes the support 7 to be released rearward. Accordingly, during a very simple maneuver, the support 7 can be easily detached from the base plate 6 and a new support can then be inserted and locked on the base plate.

FIGS. 6 to 10 illustrate another embodiment of the invention.

According to this variant, the anti-friction plate 25 is mounted in final position on a support 27, and the support 27 is fitted in the base plate 26 in a preponderantly vertical direction.

The base plate 26 incorporates, in its upper part, a central recess 28 whose dimensions correspond to the dimensions of the support 27, which is engaged approximately vertically in the recess 28 in the base plate. A projecting shoulder 31 positioned on the front edge of the support 27 engages beneath the upper surface of the base plate 26. In the region of the rear edge of the support, an elastic lip 29 fitted with a projecting shoulder 30 provides for reversible locking of the support 27 in the base plate 26.

The central recess 28 incorporates, in the area of the lip 29, a transverse slot 34 in which the blade of a tool, such as a screwdriver (diagrammed at reference 32 in FIG. 8) can be inserted in order to release the lip 29 and the shoulder 30 and to extract the support 27 from the recess 28.

Figure 9:
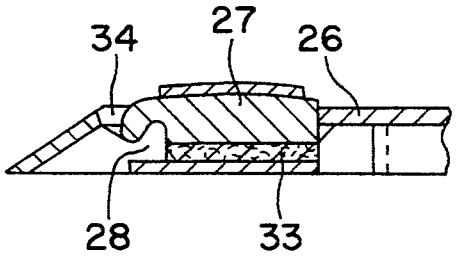
FIG. 9 illustrates a variant.

According to a variant illustrated in FIG. 9, a block 33 made of an elastically compressible material is placed beneath the support 27 on the bottom of the recess 28, so that the support rests on the block 33. Under the effect of the vertical, downward thrust exerted by the boot, the support 27 can generate compression stress on the block 33. In this variant, the means for interlocking the support 27 in the base plate 26 also constitute means for guiding the vertical motion of the support 27 in the base plate. Depending on the hardness of the block 33, a more or less perceptible damping effect may be produced on the front support position of the boot.

Figure 10:
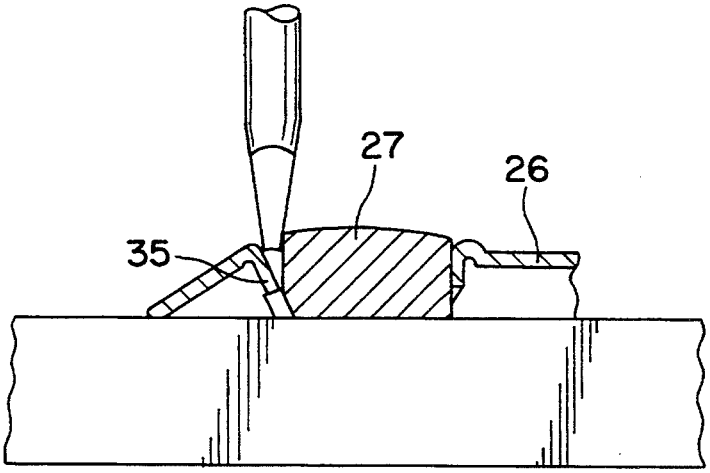
FIG. 10 illustrates another embodiment.

FIG. 10 illustrates another embodiment in which the elastic lip 35, which provides for the reversible locking of the support 27, is a part of the base plate 26. The tool is then inserted in the recess in the base plate between the lip 35 and the support 27, so as to cause the lip to be released and to allow extraction of the support.

We claim:

1. Support plate connected to a front ski binding for supporting a front part of a ski boot, said support plate comprising a base (4) extending to a rear of a mounting element (2) of said ski binding and being solid with said mounting element, a replaceable anti-friction plate (5) firmly attached to a support and supporting a sole of said ski boot, said base (4) comprising a base plate (6) and said support (7) for said anti-friction plate (5) independent of said base plate (6), said support (7) being removably assembled to said base plate (6) by mutually interlocking means (10 to 13) and reversible locking means (16, 18, 19), wherein said locking means comprise a forwardly facing deformable resilient tongue (16) and a stop (18), one of said tongue (16) and stop (18) being positioned on said base plate and the other being positioned on said support, the tongue adapted to be deformed for releasing said support from said base plate.

2. Support plate according to any one of claims 1 or 7–10 inclusive wherein said support (7) is made of a material different from the material of said base plate (6) and is compatible with the means for assembly of said anti-friction plate (5) to said support (7).

3. Support plate according to claim 2, wherein said support is made of ABS.

4. Support plate according to claim 2, wherein said base plate is made of an elastically deformable material.

5. Support plate according to claim 4, wherein said elastically deformable material is Rilsan.

6. Support plate according to any one of claims 1 or 7–10 inclusive, wherein said means for mutual interlocking of said support (7) on said base plate (6) function in a substantially longitudinal direction.

7. Support plate connected to a front ski binding for supporting a front part of a ski boot, said support plate comprising a base (4) extending to a rear of a mounting element (2) of said ski binding and being solid with said mounting element, a replaceable anti-friction plate (5) firmly attached to a support and supporting a sole of said ski boot, said base (4) comprising a base plate (6) and said support (7) for said anti-friction plate (5) independent of said base plate (6), said support (7) being removably assembled to said base plate (6) by mutually interlocking means (10 to 13) and reversible locking means (16, 18, 19), and wherein said locking means comprise a forwardly facing resilient tongue (16) and a stop (18), one of said tongue (16) and stop (18) being positioned on said base plate and the other being positioned on said support, wherein said support comprises an opening (19) to a rear of said tongue (16) through which a blade of a tool can reach said tongue, a front portion of said tongue incorporates a shoulder (22) on which said blade of said tool can rest, so that, after insertion of said blade of said tool in said opening (19), vertical pressure of said blade of said tool on said tongue releases said tongue (16) from said stop (18), and rearward pivoting of said tool causes release of said means for mutual interlocking of said support (7) and said base plate (6).

8. Support plate connected to a front ski binding for supporting a front part of a ski boot, said support plate comprising a base (4) extending to a rear of a mounting element (2) of said ski binding and being solid with said mounting element, a replaceable anti-friction plate (5) firmly attached to a support and supporting a sole of said ski boot, said base (4) comprising a base plate (6) and said support (7) for said anti-friction plate (5) independent of said base plate (6), said support (7) being removably assembled to said base plate (6) by mutually interlocking means (10 to 13) and reversible locking means (16, 18, 19), wherein said means for mutual interlocking of said base plate (26) and said support (27) function substantially vertically and comprise, for said base plate (26), a recess (28) in which said support (27) is engaged, and wherein said reversible locking means comprise an elastic lip (29, 35) able to be deformed for releasing said support from said base plate.

9. Support plate connected to a front ski binding for supporting a front part of a ski boot, said support plate comprising a base (4) extending to a rear of a mounting element (2) of said ski binding and being solid with said mounting element, a replaceable anti-friction plate (5) firmly attached to a support and supporting a sole of said ski boot, said base (4) comprising a base plate (6) and said support (7) for said anti-friction plate (5) independent of said base plate (6), said support (7) being removably assembled to said base plate (6) by mutually interlocking means (10 to 13) and reversible locking means (16, 18, 19), wherein said means for mutual interlocking of said base plate (26) and said support (27) function substantially vertically and wherein said support (27) is guided for vertical movement in a recess (28) of said base plate (26) and rests on a block (33) made of elastically compressible material positioned beneath said support (27).

10. Support plate connected to a front ski binding for supporting a front part of a ski boot, said support plate comprising a base (4) extending to a rear of a mounting element (2) of said ski binding and being solid with said mounting element, a replaceable anti-friction plate (5) firmly attached to a support and supporting a sole of said ski boot, said base (4) comprising a base plate (6) and said support (7) for said anti-friction plate (5) independent of said base plate (6), said support (7) being removably assembled to said base plate (6) by mutually interlocking means (10 to 13) and reversible locking means (16, 18, 19), wherein said means for mutual interlocking of said base plate (26) and said support (27) function substantially vertically and wherein said locking means comprise an elastically deformable lip (29) fitted with a projecting shoulder on a rear edge of said support, to enable reversible locking of said support (27) in said base plate when said lip is deformed.

* * * * *